United States Patent [19]

Morris et al.

[11] Patent Number: 4,890,695

[45] Date of Patent: Jan. 2, 1990

[54] ENGINE LUBRICATION SYSTEM

[75] Inventors: Leslie C. Morris, Washington; Craig W. Riediger, Pekin, both of Ill.

[73] Assignee: Caterpillar Inc., Peoria, Ill.

[21] Appl. No.: 358,055

[22] Filed: May 30, 1989

[51] Int. Cl.[4] ..... F01M 9/00

[52] U.S. Cl. ..... 184/6.3; 184/7.4; 123/196 R

[58] Field of Search ..... 184/6.3, 7.4; 123/196 R

[56] References Cited

U.S. PATENT DOCUMENTS 4,270,562 6/1981 Oberth et al. ..... 137/115
4,458,644 7/1984 Papst ..... 184/6.3

OTHER PUBLICATIONS

Product Specification—Liquid-Level Detector, Robertshaw Controls Company, Knoxville, Tenn., Publication date unknown.

*Primary Examiner*—Carroll B. Dority

*Attorney, Agent, or Firm*—Kenneth A. Rhoads

[57] ABSTRACT

The invention relates to a prelubrication system for an engine. It is desirable to prelubricate relatively large engines to prevent possible damage of certain components such as the crankshaft and camshaft bearings. Engines that must be started in a matter of seconds are provided with prelube pumps that run continually. During long periods of continuous prelube lubrication fluid being pumped upward into the upper rocker arm area may find its way into combustion chambers and result in damage of engine components. The present system provides a fluid level control device that prevents lubrication fluid from reaching the upper rocker arm area of the engine when the engine is not running and disables the control device when the engine is running allowing the supply of lubricant to reach the upper rocker arm area. The system further allows the engine to be started when it is sensed that there is a sufficient supply of fluid in critical areas of the engine and prevents the engine from being started if the supply of fluid is insufficient.

14 Claims, 2 Drawing Sheets

ENGINE LUBRICATION SYSTEM

DESCRIPTION

TECHNICAL FIELD

This invention relates to a lubrication system for an engine, and more particularly to a system having a prelube pump and means for preventing the supply of lubrication fluid from reaching certain elevated components when the engine is not running.

BACKGROUND ART

U.S. Pat. No. 4,270,562 which issued to Oberth, et al. on June 2, 1981 illustrates a lubrication system for relatively large engines. In such engines, it is desirable to prelube the engine, i.e. to force the lubrication of the engine prior to startup so that certain components such as the crankshaft, connecting rods and the camshaft bearings are properly lubricated. If the bearings are not provided with sufficient lubrication at the initial rotation of the engine, damage of the bearings could occur. Normally, a preestablished time delay prevents the starting circuit from being energized until prelube has been accomplished. For example, due to the size of the larger engines it may require several minutes to pump lubricating fluid to the bearings by way of the various engine galleries and passages.

Engines used to power standby generators or the like, must be started in a matter of seconds in order to respond to an emergency. Prelube for these engines is accomplished by continually pumping lubrication fluid to the bearings of the crankshaft, camshaft and rocker arms, and this permits the engine to be started without delay.

Typical prior art prelube systems have an electric or air driven pump separate from the main engine pump that supplies lubrication fluid to the engine when the engine is not running. Starting of the engine where the prelube pump has failed, whether by a loss of power to drive the pump or a problem with the pump itself, could result in a drastic reduction in the service life of the engine.

During long periods of continuous prelube, where the engine has not run for a considerable amount of time, lubricating fluid being pumped upward into the rocker arm area drips onto the valve mechanism, and can even run down valve guides, past any open valve into one or more of the engine combustion chambers. An accumulation of the incompressible fluid in a combustion chamber while cranking the engine could result in the damage of expensive engine components and require a considerable amount of time to repair.

Accordingly, what is desired is a lubrication system that will prevent lubrication fluid from entering certain elevated portions of an engine such as the rocker arm area, where fluid could otherwise find its way into a combustion chamber, when the engine is not running. The system must not be affected by engine oil temperature, viscosity or a wide range of prelube pump capacities and pressures. Moreover, when the engine is running the system must allow the supply of lubrication fluid to promptly reach the rocker arm area for lubrication of the valve operating mechanism. Also what is desired is a system that allows the engine starting mechanism to be energized solely when it is sensed that there is a sufficient supply of lubrication fluid in the critical areas of the engine, and to prevent the starting mechanism from being energized if there is an insufficient supply.

The present invention is directed to overcoming one or more of the problems as set forth above.

DISCLOSURE OF THE INVENTION

In one aspect of the invention, an engine lubrication system is provided with a first pressurized source of lubrication fluid when the engine is not running, a second pressurized source when the engine is running, first means for preventing the supply of lubrication fluid from reaching the rocker arm area when the engine is not running and second means for disabling the first means when the engine is running and allowing lubrication fluid to reach the rocker arm area.

In another aspect of the invention, an engine lubrication system is provided with pressurized source of a lubrication fluid when the engine is not running, a device for establishing a preselected maximum elevational height of lubrication fluid accumulated in the engine from the pressurized source when the engine is not running, and means for effectively blocking and disabling the device when the engine is running.

In another aspect of the invention, sensor means senses the presence of a lubrication fluid in the engine at a preselected elevational level above the normal elevational range in the sump from a prelubrication pressure source, allows the starting mechanism to be energized, and prevents the starting mechanism from being energized if there is no presence of lubrication fluid thereat.

BEST MODE FOR CARRYING OUT THE INVENTION

Figure 1:
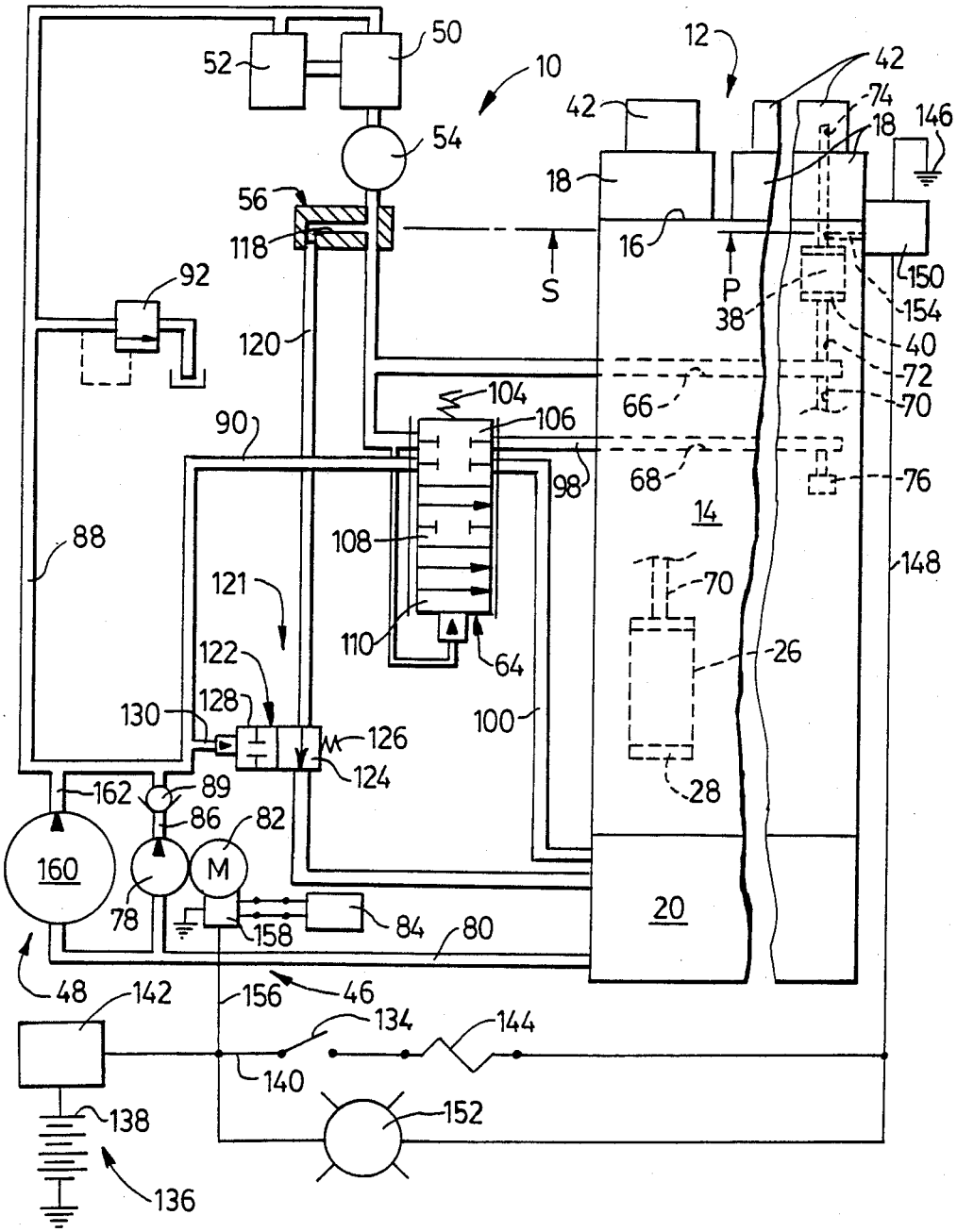
FIG. 1 is a diagrammatic illustration of an engine utilizing a lubrication system in accordance with the present invention.
Figure 2:
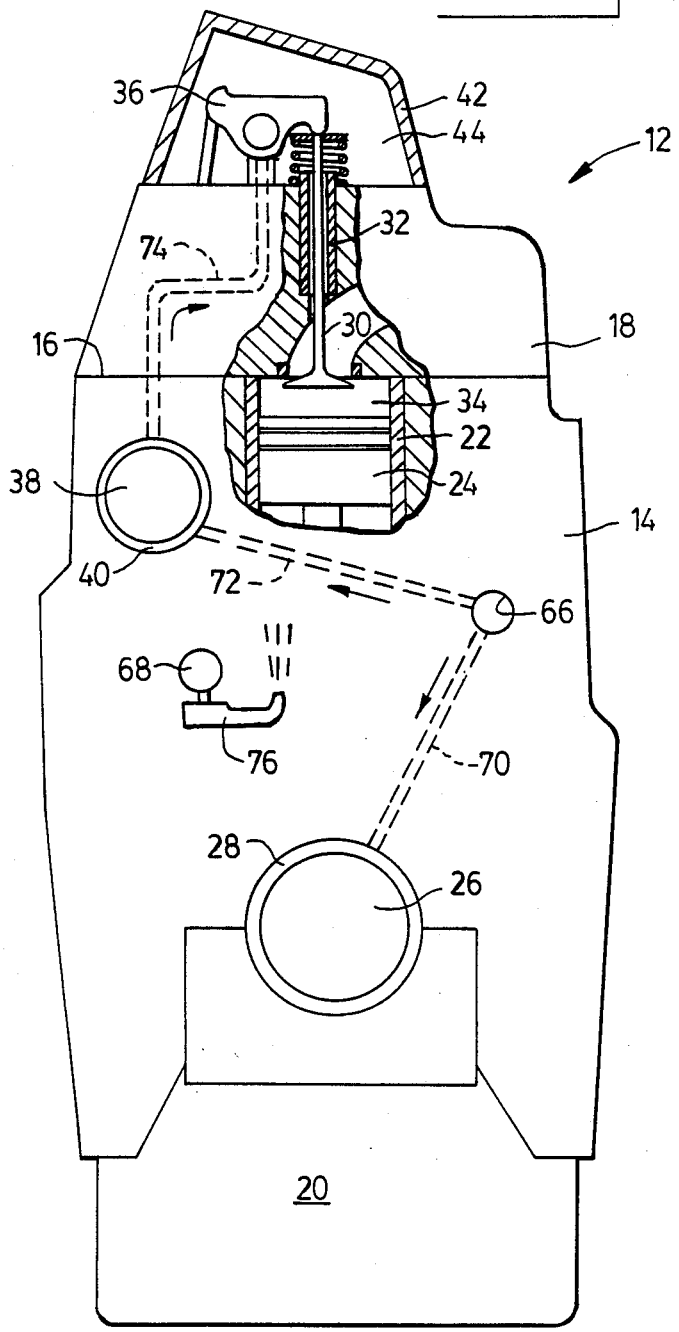
FIG. 2 is a greatly simplified diagrammatic end elevational view of an engine with a portion broken away to show details of construction thereof, and illustrating in broken lines the internal lubrication galleries and passages therein.

Referring now to Figs. 1 and 2, a lubrication system 10 is shown for a relative large internal combustion engine 12 of the type used to drive emergency standby generators, pumps or the like.

The engine 12 includes a block 14 having a top head mounting surface 16, a plurality of cylinder heads 18 removably secured to the top surface, a fluid reservoir or sump 20 for holding an engine lubricant such as oil and having a normal maximum elevational range of lubrication fluid therein, and a plurality of cylinders 22, one of which is shown. In the specific instance the sump 20 is integral with the engine 12, but it is recognized that the sump could be remotely located. Each cylinder 22 has a piston 24 slidably disposed therein for driving a crankshaft 26 in a conventional manner. The crankshaft 26 is rotatable supported in the engine 12 by a plurality of bearings one of which is shown at 28.

As representatively illustrated, each cylinder 22 has at least one valve 30 that is slidably disposed in a cylindrical guide 32 formed in the cylinder head 18 and opening into a combustion chamber 34 formed by the cylinder head 18, the cylinder 22, and the piston 24. A oscillating rocker arm 36 acts on the valve 30 in response to rotation of a camshaft 38 supported in the engine 12 by bearings, one of which is shown at 40. The valves 30 control the flow of inlet air and exhaust gases into and out of the cylinders 22 during engine operation in a conventional manner. A plurality of covers 42 are removably secured to each cylinder head 18 and define an upper rocer arm area 44 elevationally spaced above each cylinder head.

The lubrication system 10 includes a first pressure source 46, a second pressure source 48, a lubricant temperature regulator 50, a lubricant cooler 52, a plurality of lubricant filters 54 and a first means or a fluid level control device 56 for preventing the supply of lubricant from reaching the rocker arm area 44 under certain conditions, and a infinitely variably, pressure actuated, three-position, priority valve 64.

The engine 12 further includes a main fluid gallery 66 and a secondary fluid gallery 68 integral with the block 14. The priority valve 64 is in fluid communication with the secondary fluid gallery 68 and with the sump 20. A plurality of passages, one of which is shown at 70, transmit lubricant downward from the main fluid gallery 66 to the bearings 28 for the crankshaft 26. Lubricant is also transmitted from the main fluid gallery 66 upward to the bearings 40 for the camshaft 38 by a plurality of passages one of which is shown at 72. From the bearings 40 lubricant is transmitted to the rocker arm area 44 by a plurality of passages in the block 14 and the heads 18, one of which is shown at 74. Lubrication is transmitted from the secondary fluid gallery 68 to a plurality of jets, one of which is shown at 76, for cooling of the pistons 24.

The first pressure source 46 includes a prelube pump 78 in fluid communication with the sump 20 via a conduit 80, and is operable only when the engine 12 is not running. The prelube pump 78 is of a relatively low capacity, and has a low pressure capability. By the term low capacity it is meant approximately 23 liters per minute (6 gpm) by the term low pressure it is meant approximately 137.8 kPa (20 psi). In this specific instance the prelube pump 82 is driven by an AC electric motor 82 which receives power from an electrical source 84 having for example 220 volts. It is also recognized that the prelube pump 78 could be driven by a DC electric motor or an air motor.

Lubrication fluid is supplied from the prelube pump 78 via a conduit 86 to an inlet conduit 88 that connects with the priority valve 64 and the main fluid gallery 66. The regulator housing 50, cooler 52, filters 54 and fluid level control device 56 are located in the inlet conduit 88. A one way check valve 89 is located in conduit 86. Fluid is also supplied via a branch conduit 90 to the priority valve 64. A lubrication system relief valve 92 is connected to the conduit 88 and has a relief setting of for example 1000 kPa (145 psi). The priority valve 64 is connected to the secondary fluid gallery 68 via a conduit 98 and to the sump 20 via a conduit 100.

The priority valve 64 is biased downward, when viewing FIG. 1, by a spring 104 towards a first position 106 as shown blocking the delivery of the fluid from the inlet conduit 88 to the secondary fluid gallery 68 until the pressure in the inlet conduit 88 reaches a value to overcome the bias of the spring in a manner to be described presently. In the first position 106 the conduit 100 connected to the sump 20 is blocked. The priority valve 64 has a second position 108 in which the fluid is modulateably directed to the secondary fluid gallery 68 and the conduit 100 remains blocked and a third position 110 wherein fluid is modulateably directed to the second fluid gallery and to the sump 20 via conduit 100 from conduit 90. It is noted that flow to the main fluid gallery 66 is never obstructed in any way.

The fluid level control device 56 in the inlet conduit 88 establishes a preselected maximum elevational height of the lubrication fluid accumulated in the engine 12 from the prelube pump 78. The device 56 includes a spillway 118 connected to a return conduit 120 connected to the sump 20 of the engine 12. Preferably the elevational height "S" of the spillway 118 is above the normal maximum elevational range of the lubrication fluid in the sump 20 or adjacent or slightly below the top surface 16 of the block 14. In all instances the spillway 118 should be above the camshaft bearings 40 and below the upper rocker arm area 44.

Second means or a disabling apparatus 121 for blocking the fluid level control device 56 includes in this specific instance a pilot operated, two position valve 122 located in the return conduit 120. The valve 122 is biased to the left when viewing FIG. 1 towards a first normally open position 124 by a spring 126 that permits unrestricted flow of fluid to the sump 20 via conduit 120 until a pilot pressure in a pilot line 130 connected between the valve 122 and the conduit 90 reaches a value to overcome the spring and shift the valve to a second position 128. In the second position 128 flow is blocked to the sump 20 disabling the device 56. It is recognized that the two position valve 122 could also be pneumatic or electrically operated.

One side of a start switch 134 is connected to a power source 136 such as a battery 138 via an electrical line 140. This electrical line 140 can be interrupted by an engine speed sensing switch 142. The opposite side of the start switch 134 is connected to an air start solenoid valve 144 for operation of an air starting motor, not shown, which is used to crank the engine 12 in a conventional manner. The opposite side of the solenoid valve 144 is connected to an electrical ground 146 via an electrical line 148 and a sensor or liquid-level detector 150. A signal light 152 is lighted when an electrical circuit is completed through the detector 150.

The detector 150 is preferably attached to the block 14 and has a probe portion 154 that extends into one of the passages 74 for sensing the presence of lubrication fluid therein. Preferably the elevational height "P" of the probe 154 above the normal range of maximum fluid level in the sump 20 is adjacent or slightly below the top surface 16 of the block. In all instances the probe 154 will be located at an elevational level above the camshaft bearing 40 and at or below the spillway 118. The detector 150 is of the type marketed by Robertshaw Controls Company, Tennessee Division, Knoxville, Tenn. as model 624.

Electrical energy is also provided via an electrical line 156 to a solenoid switch 158 which controls when electrical energy is directed to the electric motor 82. The second pressure source 48 includes a helical gear primary pump 160 driven, in this specific instance, by the engine 12. It is recognized that the pump 160 could alternatively be driven by air or an electric motor. The pump 160 is in fluid communication with the sump 20 via the conduit 80 and connected via a conduit 162 to the conduit 88. The pump 160 is operable only when the engine 12 is running and is of a relatively high capacity and is capable of supplying lubricant at moderate pressure levels via the lubrication system 10 to all areas of the engine 12 that requires lubrication including the camshaft bearings 40, the crankshaft bearings 28 and the upper rocker arm area 44. By the term high capacity it is meant less than approximately 1000 to 1800 liters per minute (260 to 468 gallons per minute) and by the term moderate pressure level it is meant less than approximately 1000 kPa (145 psi).

Industrial Applicability

With the engine 12 in the standby mode lubrication fluid is pumped by the prelube pump 78 from the sump 20 at a relatively low pressure to the main fluid gallery 66 and to the passages 70, 72, and 74 for lubrication of the crankshaft bearings 28 and the camshaft bearings 40. The prelube pump 78 is driven by the electric motor 82 which receives electrical energy from source 84. Prelubrication of the critical areas of the engine 12 permits the engine to be started in a matter of seconds without damage to the engine.

Lubrication fluid is pumped via inlet conduit 88 through the regulator 50, the filter assembly 54 and the level control device 56 to the priority valve 64 and to the main gallery 66. Fluid to the secondary gallery 68 is blocked by the priority valve 64. Fluid will fill the passages 70, 72 and 74 until it reaches a predetermined elevational height "S" above the normal range of maximum fluid level in the sump 20 to a level as determined by the spillway 118 of the control device 56. Whereupon excess lubrication fluid accumulated in the engine 12 is returned into return conduit 120 where it is returned to the sump 20 in a unrestricted manner. The system has the advantage of not being affected by engine oil temperature, viscosity or a wide range of prelube pump 78 capacities and pressures. Valve 122 is biased to it normally open position by the spring 126 when the engine 12 is stopped. The control device 56 prevents the supply of fluid from reaching certain elevated portions of the engine 12 such as the upper rocker arm area 44. In this specific instance the level of fluid in the engine 12 is maintained at slightly below the top surface 16 of the block 14 and above the camshaft bearings 40. It is readily recognized that for a predetermined elevational location of the control device 56 a specific level of fluid in the engine can be controlled.

The probe 154 of the liquid detector 150 extends into one of the passages 74 at a preselected an elevational height "P" above the normal range of maximum fluid level in the sump 20 is adjacent or slightly below the elevational level of the spillway 118. The probe 154 produces a change in electrical "capacitance" when liquid displaces air immediately surrounding the probe. The electrical capacitance change is then converted within the unit into an on-off solid state switch closure to indicate the absence or the presence of fluid around the probe 154. The detector 150 is used to determine if there is lubrication fluid present in passage 74 at the elevational level of the probe 154. If there is a presence of fluid the electrical circuit between the solenoid valve 144 and the electrical ground 146 will be completed. Signal light 152 will be lighted when the circuit through the detector 150 is completed. By then closing start switch 134 the solenoid valve 144 for the starting motor will be energized permitting the engine 12 to be started. In the absence of fluid in the passage 74 the detector will not complete the circuit between the solenoid valve 144 and the ground 146 and the engine 12 can not be started. Absence of fluid in the conduit 74 at the level of the probe 154 would be an indication that the bearings 28 and 40 may not be receiving prelubrication and it would be detrimental to start the engine 12 without possible damage to expensive engine components.

With the presence of electrical energy at the solenoid switch 158 the switch will be closed and the motor 82 will receive power from the electrical source 84 to drive the motor. When engine 12 is started, the engine driven pump 160 becomes the source of pressurized fluid for the lubrication system 10. The pressure in the system 10 is dependent upon the speed of engine 12. Upon a rise of the pressure in conduit 88 and pilot line 130 to a point that exceeds a level as determined by the preload of the spring 126 of valve 122 the valve will shift to its second position 128 blocking the flow of fluid to the sump 20 from the fluid level control device 56 via conduit 120 disabling the device 56. Thus all the flow from pump 160 is directed to the main fluid gallery 66.

When the engine 12 is operating at a preselected speed, for example 250 revolutions per minute, as sensed by speed sensing switch 142 the electrical energy to the solenoid switch 158 from the battery 138 is interrupted by the sensing switch 142. This opens the solenoid switch 158 preventing electrical energy from the source 84 to reach the motor 82. Once pump 78 is stopped fluid from the relatively high pressure engine driven pump 160 is prevented from flowing through line 86 by the check valve 89. Because of the close internal working tolerances of the helical gear pump 160 fluid is prevented from flowing back through the pump to the sump 20 when the relatively low capacity and low pressure prelube pump is operating.

Once the engine 12 is operating at a sufficient speed so that the pump 160 is producing fluid above a pressure for example 140 kPa (20 psi) the pressure in inlet conduit 88 will exceed a level as determined by the preload of spring 104 and the priority valve 64 will be shifted to its second position 108. In the position 108 lubrication fluid will be modulateably directed from the inlet conduit 88 to the secondary gallery 68 and to the cooling jets 76 for cooling of the pistons 24.

When the engine 12 is operating at even a higher speed so that the pump 160 is producing a pressure of for example 430 kPa (63 psi) the pressure in inlet conduit 94 will exceed a level as determined by the preload of spring 104 and the priority valve 64 will be shifted to its third position 110. In the position 110 lubrication fluid will be modulateably directed from the inlet conduit 88 to the secondary gallery 68 and from conduit 90 to the sump 20 via the conduit 100. The third position 110 of the priority valve 64 provides a bypass of a portion of the fluid from pump 160 to the sump 20 so that smaller size cooler 60 and filter assembly 62 can be used. This assures that any reasonably small pressure loss which may take place in the filters does not in any way effect the regulation of the operating pressure at the main gallery 66 and the secondary gallery 68. For a more complete understanding of the operation of the priority valve 64 reference is made to the U.S. Pat. No. 4,270,562 referred to above.

In summary, it can be appreciated that when the engine 12 is not running and the engine is being prelubricated, lubricant is prevented from reaching certain elevated portions of the engine such as the upper rocker arm area 44 by a fluid level control device 56 that establishes a preselected maximum elevational height of the lubricant in the engine by returning excess fluid to the sump 20. When the engine 12 is running the control device 56 is disabled by the blocking the return of fluid to the sump 20 and allowing the supply of lubricant to reach the rocker arm area 44 for lubrication of the valve operating mechanism. A fluid detector 150 senses the presence of fluid in the passage 74 at a preselected elevational height. When it is sensed that there is a sufficient supply of lubricant in the critical area of the engine the engine start mechanism can be energized. Because the lubricant in the engine 12 is maintained at a relatively high level, lubrication fluid will promptly reach the rocker arm area 44 when the engine is started.

Although the present system has been described and disclosed with respect to an inline type engine 12, it is recognized that the system could equally be used on vee type engines.

Other aspects, objects and advantages can be obtained from a study of the drawings, the disclosure and the appended claims.

We claim:

1. A lubrication system for an engine having an upper rocker arm area and including a first pressurized source for supplying a lubrication fluid to the engine when the engine is not running, and a second pressurized source for supplying the lubrication fluid to the engine when the engine is running, comprising:

first means for preventing the supply of the lubrication fluid from the first pressurized source from reaching the upper rocker arm area when the engine is not running; and, second means for disabling the first means when the engine is running and allowing the supply of lubrication fluid to reach the rocker arm area from the second pressurized source.

2. The lubrication system of claim 1 wherein the second pressure source includes a primary pump and the first pressure source includes a prelube pump having appreciably less flow capacity and pressure level generating capacity than the primary pump.

3. The lubrication system of claim 2 including an electrically driven motor for driving the prelube pump, a speed sensing switch for electrically disconnecting the electrically driven motor in response to the engine reaching a preselected speed.

4. The lubrication system of claim 1 including an inlet conduit in fluid communication with the engine, and the engine includes a sump having a normal maximum elevational range of a lubricant therein and the first and second means being in fluid communication with the sump and the inlet conduit.

5. The lubrication system of claim 4 wherein the first means includes a spillway connected to the inlet conduit and a return conduit connected between the spillway and the sump.

6. The lubrication system of claim 5 wherein the second means includes a valve for blocking the return conduit in response to a preselected pressure level in the inlet conduit.

7. The lubrication system of claim 6 wherein the valve is a pilot operated, two position, spring biased valve.

8. The lubrication system of claim 6 wherein the spillway is located at a preselected elevational level "S" and the engine has a plurality of passages therein connected to the inlet conduit and including a detector attached to the engine and connected to one of the passages for preventing the starting of the engine if the lubrication fluid is not present at the preselected level "S" in the engine.

9. A lubrication system for an engine including a sump having a normal maximum elevational range of a lubrication fluid therein, an inlet conduit and a pressure source for supplying the lubrication fluid to the inlet conduit from the sump when the engine is not running, comprising:

a device connected to the inlet conduit and establishing a preselected maximum elevational height of the lubrication fluid accumulated in the engine from the pressure source above the normal maximum elevational range in the sump; and a disabling apparatus for effectively blocking and disabling the device in response to running of the engine.

10. The lubrication system of claim 9 wherein the device includes a spillway connected to the inlet conduit, a return conduit connected to the sump and the spillway adapted to communicate excess lubrication fluid accumulated in the engine over the spillway into the return conduit.

11. The lubrication system of claim 10 wherein the disabling apparatus includes a valve for blocking the return conduit in response to a preselected pressure level in the inlet conduit.

12. The lubrication system of claim 11 wherein the valve is a pilot operated, two position, spring biased valve.

13. The lubrication system of claim 10 wherein the spillway is located at a preselected elevational level "S" and the engine has a plurality of passages therein connected to the inlet conduit and includes a detector attached to the engine and connected to one of the passages for preventing the starting of the engine if the lubrication fluid is not present at the preselected level "S" in the engine.

14. The lubrication system of claim 13 wherein the engine includes a camshaft having a plurality of bearings and an upper rocker arm area and the preselected elevational level "S" is above the above the bearings and below the rocker arm area.

* * * * *